US005881734A

United States Patent [19]

Trayes

[11] Patent Number: 5,881,734

[45] Date of Patent: Mar. 16, 1999

[54] NAIL POLISH BOTTLE HOLDER

[76] Inventor: Elaine Trayes, 174 N. Oak, Wood Dale, Ill. 60191

[21] Appl. No.: 55,740

[22] Filed: Apr. 6, 1998

[51] Int. Cl.[6] ..... A45D 29/00; A45D 29/18; A45D 29/20

[52] U.S. Cl. ..... 132/73; 132/73.5; 132/75; 132/74.5

[58] Field of Search ..... 132/73, 73.5, 74.5, 132/75; 248/102, 104; 224/219, 221

[56] References Cited

U.S. PATENT DOCUMENTS

| | | | |
|---|---|---|---|
| 2,389,390 | 11/1945 | Silverman et al. | 215/11 |
| 2,659,920 | 11/1953 | Bogan et al. | 15/140.4 |
| 3,065,944 | 11/1962 | Liebendorfer | 248/102 |
| 4,848,625 | 7/1989 | Lucia | 224/250 |
| 5,397,039 | 3/1995 | Parcelles | 224/148 |
| 5,567,070 | 10/1996 | Ficcadenti | 132/73 |
| 5,582,335 | 12/1996 | Beard et al. | 224/148.5 |
| 5,664,711 | 9/1997 | Mellon | 132/73 |

*Primary Examiner*—John J. Wilson
*Assistant Examiner*—Trang Doan
*Attorney, Agent, or Firm*—Patrick J. Walsh

[57] ABSTRACT

A nail polish bottle holder having a receptor well for the bottle and an elongate strap affixed to the well for securing the holder in a convenient place as for example a woman's wrist.

3 Claims, 2 Drawing Sheets

NAIL POLISH BOTTLE HOLDER

BACKGROUND OF THE INVENTION

The present invention relates to supports and particularly to a support or holder for a bottle of nail polish.

Nail polish is ordinarily applied to the nails from a small bottle using a brush applicator affixed to the closure cap for the bottle. The bottle is small so that it is necessary to secure the bottle, as by holding it with one hand, as the applicator is dipped into the bottle. The bottle is then set aside as the applicator applies its fill of polish to a fingernail. These steps are repeated until all nails are polished.

The steps involved impose limits as to the conditions permitting proper nail polishing. Specifically, nail polishing is limited to a person being at rest preferably sitting and with a table or other handy surface for setting down the polish bottle as the hands are occupied with nail polishing.

In the hub-bub of daily routine with women on the go and so forth, it is often necessary if not desirable to deal with cosmetic applications while commuting to work, for example. Accordingly, the present invention provides a nail polish holder facilitating the application of nail polish on the go.

SUMMARY OF THE INVENTION

The invention provides a nail polish bottle holder including a receptor well for the bottle with the receptor well attached to an elongated flexible tube or strap for securing the holder. The strap or tube is wrapped around a convenient support such as a person's wrist, a lamp, nightstand, to a car door, and so forth. While the holder is placed as desired, a bottle of nail polish is placed in the receptor well, opened, and available without further handling, for the repeated dipping of the applicator into the bottle as necessary for polishing the nails.

OBJECTS OF THE INVENTION

An object of the invention is to provide a support for a nail polish bottle while polishing the nails.

Another object of the invention is to provide a nail polish bottle holder for enabling a person to polish her nails on-the-go.

Another object of the invention is to provide a nail polish bottle holder suitable for attachment to a variety of supporting means such as a nightstand or person's wrist while polish is applied to the nails.

Other and further objects of the invention will become apparent with an understanding of the following detailed description of the invention or upon employment of the invention in practice.

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
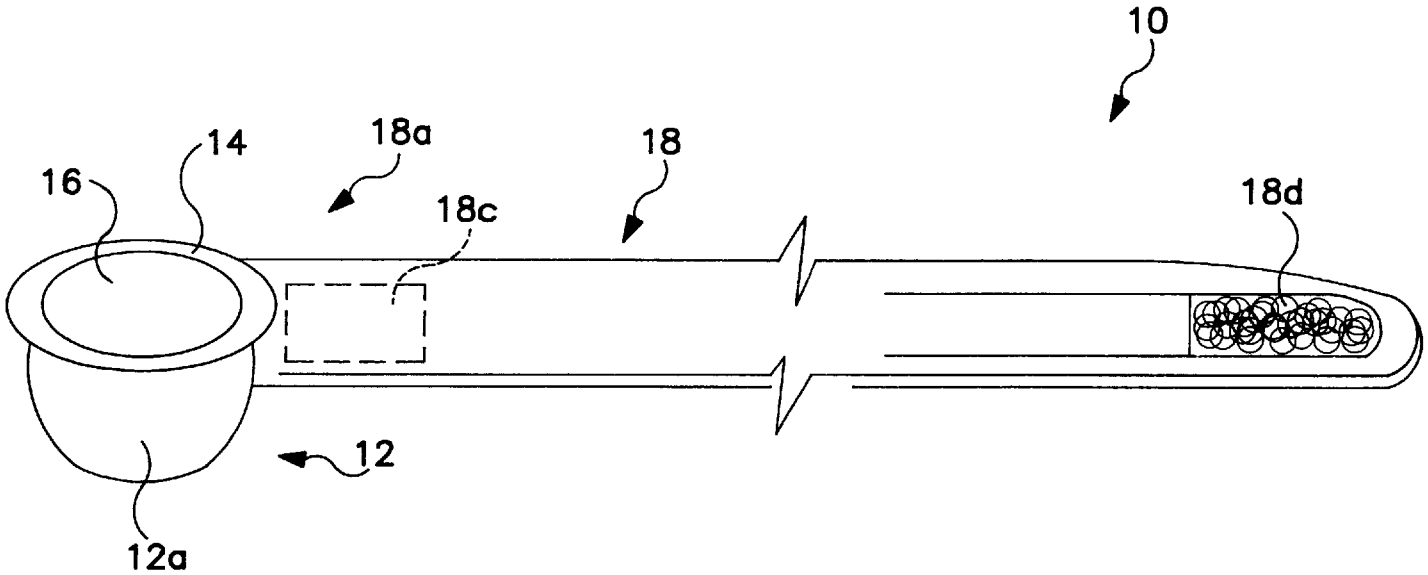
FIG. 1 is a perspective view of the nail polish bottle holder according to the invention.
Figure 2:
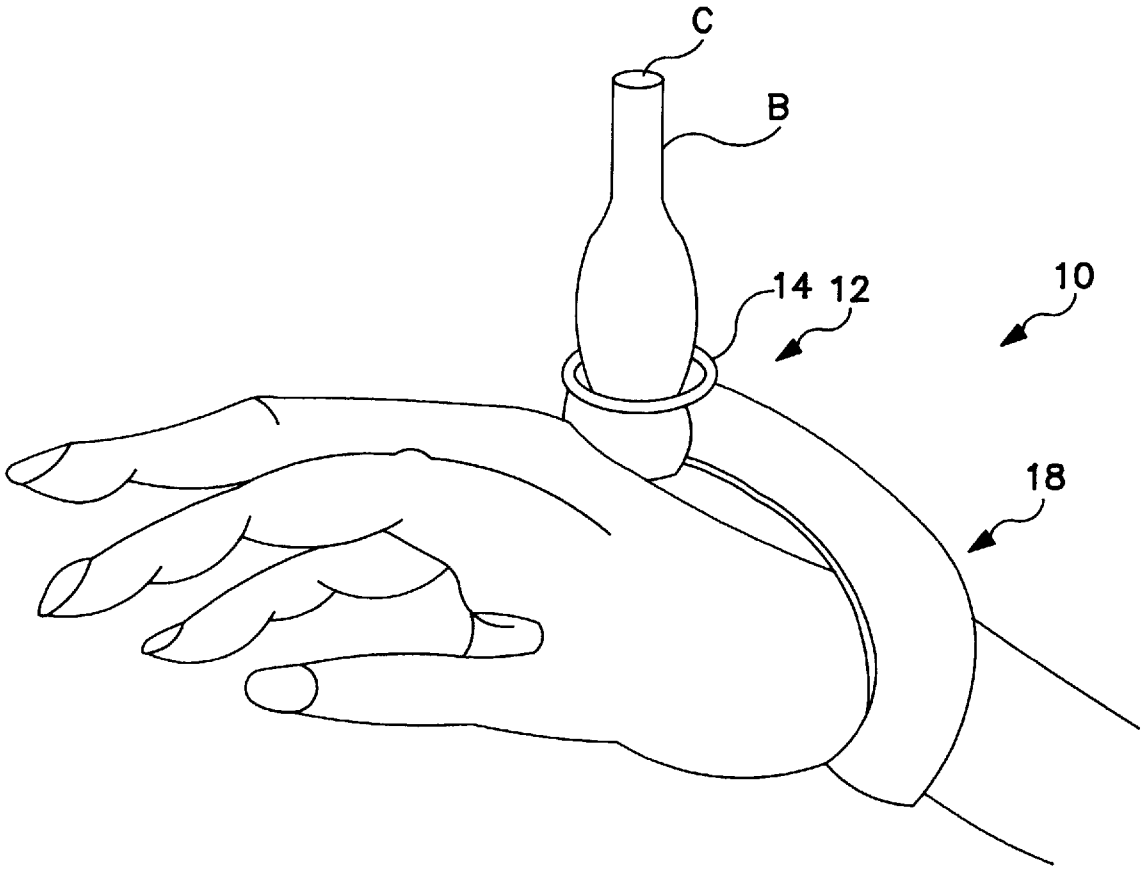
FIG. 2 is a perspective of the holder of FIG. 1 applied to a woman's wrist.

Referring to the drawing, the nail polish bottle holder 10 comprises a receptor well 12 in the form of a cup with a rim 14 at the open end 16 of the cup. The cup is dimensioned to receive and securely hold a small commercially available nail polish bottle B equipped with a combined closure cap C applicator. The well may be fabricated of any suitable material such as plastic.

An elongated flexible tube or strap 18 is permanently secured at one of its ends 18*a* to the outer side 12*a* of the well. The strap is sufficiently flexible for wrapping about small circumferences such as a wrist W. Opposite ends 18*a*, 18*b* of the strap are fitted with securement means 18*c*, 18*d* for retaining the bottle holder in place on a wrist. The securement means may be a hook and loop fastener (Velcro™) or adhesive patches suitable for repeated use.

In use, the nail polish bottle holder is wrapped about the wrist, and a bottle is inserted into the well. The bottle is opened, and polish is applied to the nails with repeated dipping and stroking of the applicator to the nails. It will be readily understood that a woman may now polish her fingernails in any convenient place including a moving vehicle.

Various changes may be made to the structure embodying the principles of the invention. The foregoing embodiment is set forth in an illustrative and not in a limiting sense. The scope of the invention is defined by the claims appended hereto.

I claim:

1. A nail polish bottle and holder said holder comprising a receptor well for receiving and securely holding a nail polish bottle, the well having an outer side, an elongated flexible strap permanently secured at one of its ends to the outer side of the well, the strap being sufficiently flexible for wrapping about a support having a small circumference, securement means comprising cooperating fasteners with one cooperating fastener fitted to one end of the strap, and with another cooperating fastener fitted to another end of the strap adjacent the receptor well, and the strap wrapped about a support with the fasteners secured to each other for retaining the bottle holder in place on said support receiving and supporting said nail polish bottle for application of polish.

2. The holder as defined in claim 1 in which the securement means is a hook and loop fastener.

3. The holder as defined in claim 1 in which the securement means comprises adhesive patches suitable for repeated use.

* * * * *